US006955021B2

(12) United States Patent
Thomas

(10) Patent No.: US 6,955,021 B2
(45) Date of Patent: Oct. 18, 2005

(54) COVERS, SYSTEMS AND METHODS FOR COVERING DECK COMPONENTS

(76) Inventor: Rodney H. Thomas, #2 Masonridge Ct., Town and Country, MO (US) 63141

( * ) Notice: Subject to any disclaimer, the term of this patent is extended or adjusted under 35 U.S.C. 154(b) by 27 days.

(21) Appl. No.: 10/662,206

(22) Filed: Sep. 12, 2003

(65) Prior Publication Data

US 2005/0055924 A1 Mar. 17, 2005

Related U.S. Application Data

(60) Provisional application No. 60/495,969, filed on Aug. 18, 2003.

(51) Int. Cl.[7] ..... E04H 12/00

(52) U.S. Cl. ..... 52/650.3; 52/773; 52/511; 52/512; 52/510

(58) Field of Search ..... 52/650.3, 177, 52/178, 179, 180, 483.1, 716.2, 773, 731.1, 489.1, 489.2, 511, 512, 510

(56) References Cited

U.S. PATENT DOCUMENTS

| | | | | |
|---|---|---|---|---|
| 3,128,851 A | | 4/1964 | Deridder et al. | |
| 4,593,506 A | | 6/1986 | Hartman et al. | |
| 4,703,597 A | | 11/1987 | Eggemar | |
| 4,885,882 A | | 12/1989 | Forshee | |
| 4,907,387 A | | 3/1990 | Turnbull | |
| 4,951,992 A | | 8/1990 | Hockney | |
| 5,050,362 A | | 9/1991 | Tal et al. | |
| 5,326,187 A | | 7/1994 | St. Marie et al. | |
| 5,332,602 A | | 7/1994 | Barre et al. | |
| 5,351,458 A | * | 10/1994 | Lehe | 52/586.2 |
| 5,448,865 A | | 9/1995 | Palmersten | |
| 5,509,244 A | | 4/1996 | Bentzon | |
| 5,613,339 A | | 3/1997 | Pollock | |
| 5,735,097 A | * | 4/1998 | Cheyne | 52/489.1 |
| 5,775,048 A | * | 7/1998 | Orchard | 52/712 |
| 5,794,390 A | | 8/1998 | Oliveri et al. | |
| 5,816,010 A | | 10/1998 | Conn | |
| 5,833,386 A | | 11/1998 | Rosan et al. | |
| 5,901,518 A | * | 5/1999 | Harkins | 52/404.3 |
| 5,904,011 A | | 5/1999 | Biro | |
| 5,913,784 A | * | 6/1999 | Hite | 52/177 |
| D421,502 S | | 3/2000 | Felch et al. | |
| 6,044,598 A | * | 4/2000 | Elsasser et al. | 52/181 |
| 6,170,212 B1 | | 1/2001 | Suchyna et al. | |

(Continued)

OTHER PUBLICATIONS

U.S. Appl. No. 10/662,205, filed Sep. 12, 2003, Thomas, entitled Covers, Systems and Methods for Covering Deck Components.

2 pages entitled *LockDry Aluminum Decking*.

7 pages entitled *LockDry Aluminum Decking, FSI Home Products Division, Installation Instructions*.

2 pages entitled *Anchor Decking Introduces Durable Deck—The Vinyl Retrofit Solution*, published at www.prweb.com/releases/1999/6/prweb8363.php.

6 pages entitled *Durable Deck Vinyl Decking*, published at www.coxlumber.com/decking2.html.

2 pages published at www.durabledeck.com/PRFiles/ProdReleases.htm.

*Primary Examiner*—Carl D. Friedman
*Assistant Examiner*—Nahid Amiri
(74) *Attorney, Agent, or Firm*—Harness, Dickey & Pierce, P.L.C.

(57) ABSTRACT

Covers, systems and methods for covering boards and deck components, such as the floorboards, side rails, among other elongate structural deck components. In one embodiment, a cover generally includes a top portion and a pair of opposed side portions downwardly depending from the top portion to frictionally receive and grip the board between the side portions when the cover is positioned on the board. Each of the cover's side portions define at least one slot adapted to extend around portions of another board or joist positioned below the board when the cover is positioned on the board.

23 Claims, 9 Drawing Sheets

U.S. PATENT DOCUMENTS 6,260,328 B1 7/2001 Fowler et al.
6,374,555 B1 4/2002 Gusler
6,401,286 B1 * 6/2002 Brenn ..... 14/73
D459,818 S 7/2002 Chaney et al.
6,584,748 B2 * 7/2003 Bresnahan ..... 52/650.3
6,594,961 B2 * 7/2003 Leines ..... 52/177
6,651,398 B2 * 11/2003 Gregori ..... 52/489.1
6,688,054 B2 * 2/2004 Pasterchick ..... 52/177
6,694,681 B1 * 2/2004 Andres ..... 52/177

* cited by examiner

COVERS, SYSTEMS AND METHODS FOR COVERING DECK COMPONENTS

CROSS-REFERENCE RELATED TO APPLICATION

This application claims priority to U.S. Provisional Application No. 60/495,969, filed Aug. 18, 2003, titled "Covers, Systems and Methods for Covering Deck Components" of Rodney H. Thomas.

FIELD

This invention relates generally to decks, and more particularly (but not exclusively) to covers, systems and methods for covering deck components, such as the floorboards, side rails, among other elongate deck components.

BACKGROUND

Decks are typically constructed of wood, plastic or a wood plastic composite. These decks are often constructed using standard nails, screws, and other conventional construction techniques to secure the various component parts of the deck together. For example, nails are often used to secure the floorboards to support members and to construct other features of the deck. Further, and for example, a deck may include side rails for enclosing the deck structure and/or integrated benches for providing seating.

Wood decks are often constructed of wood that has been chemically impregnated to retard decomposition. The treated wood typically includes various additives, some of which may be harmful, particularly to children and pets. For example, treated wood for use in constructing decks often includes arsenic, which is potentially dangerous to users of the deck.

In addition, extensive maintenance of wood components is normally required, particularly in geographic areas subject to extreme changes in or harsh weather conditions (e.g., excessive rain or sunlight, etc.). For example, periodic treatment of the deck surface with a water sealer or similar protecting agent is normally required to slow damage to the deck (e.g., splitting of the wood, etc.) caused by weather conditions. Further, a stain or similar type of material for maintaining a desired color of the deck is often used, and typically requires periodic application. These protecting agents and stains add cost to the maintenance of the deck. Additionally, despite efforts to maintain the condition of the deck (e.g., sealing the deck yearly to prevent damage, etc.), floorboards, railing boards, and other parts of the deck often must be replaced as a result of continuous exposure to outdoor elements.

Because decks are typically constructed using standard wood nails, these nails often loosen from the wood and become raised due to expansion and/or contraction of the wood components over time. These raised nails result in a potentially dangerous condition that may cause injury to users of the deck (e.g., injury to a user's foot while walking on the deck, etc.).

SUMMARY

One exemplary embodiment includes a cover for a board or deck component. The cover includes a top portion and a pair of opposed side portions downwardly depending from the top portion to frictionally receive and grip the board between the side portions when the cover is positioned on the board. Each of the cover's side portions define at least one slot adapted to extend around portions of another board or joist positioned below the board when the cover is positioned on the board.

Another exemplary embodiment includes a deck. The deck includes at least one floorboard, at least one joist below the floorboard, and at least one cover. The cover includes a top portion and a pair of opposed side portions downwardly depending from the top portion. The cover's top portion and side portions are adapted to generally cover at least the top and sides of the floorboard. Each of the cover's side portions including at least one slot adapted to extend around portions of the joist when the cover is positioned on the floorboard.

Another exemplary embodiment includes a cover for an elongate deck component, such as a floorboard. The cover includes a top portion and a pair of opposed side portions downwardly depending from the top portion. The cover's top portion and side portions are adapted to generally cover at least the top and sides of the deck component. Each of the cover's side portions including at least one opening therein for venting an area between the cover and the deck component when the cover is positioned on the deck component.

In another form, the invention provides methods for protecting a board in a deck. In one embodiment, the method generally includes positioning on the board a cover having a top portion and a pair of opposed side portions downwardly depending from the top portion such that slots defined in the cover's side portions extend around portions of another board positioned below the board.

Further areas of applicability of the present invention will become apparent from the detailed description provided hereinafter. It should be understood that the detailed description and specific examples, while indicating the exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference characters indicate corresponding features throughout the drawings.

DETAILED DESCRIPTION OF THE EXEMPLARY EMBODIMENTS

Figure 1A:
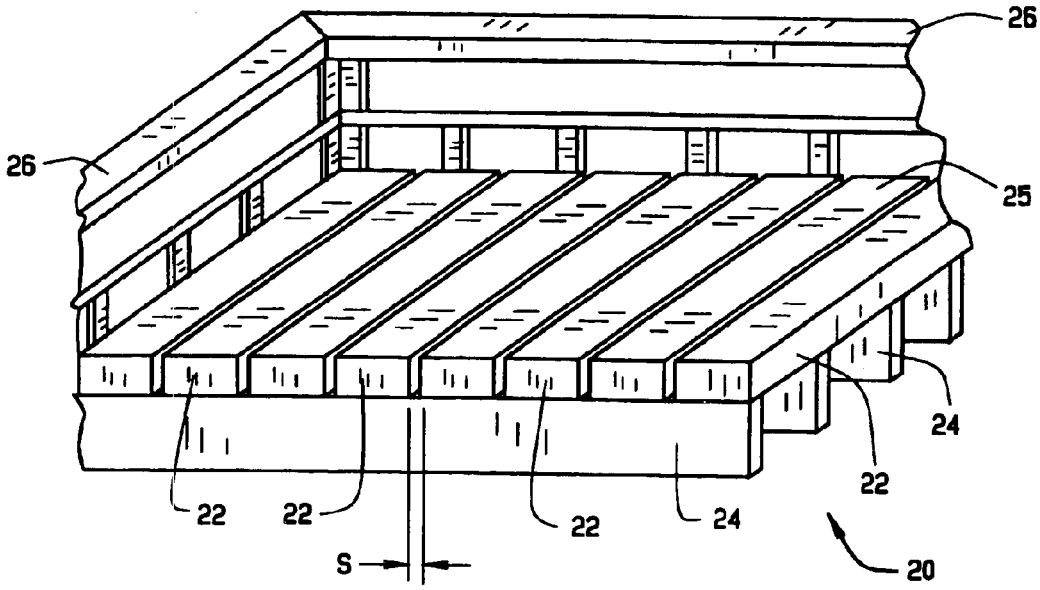
FIG. 1A is a partial top perspective view of an exemplary deck in conjunction with which embodiments of the invention may be implemented.
Figure 1B:
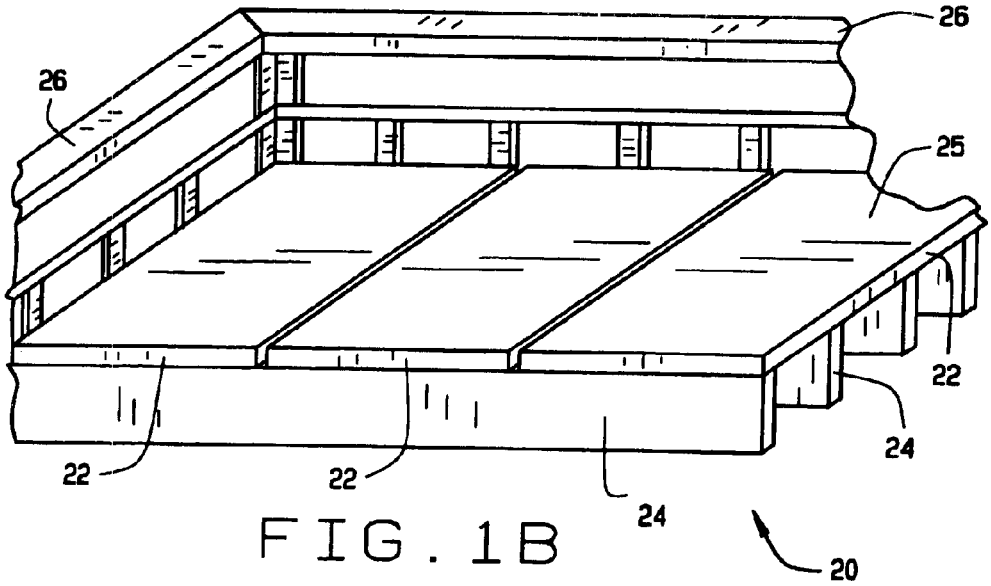
FIG. 1B is a partial top perspective view of an exemplary deck constructed with plywood floorboards in conjunction with which embodiments of the invention may be implemented.

FIGS. 1A and 1B illustrate exemplary decks 20 in conjunction with which at least some embodiments of the invention may be implemented. As shown in FIG. 1A, the deck 20 includes a plurality of floorboards 22 of a conventional size, such as two-by-two (2×2), two-by-four (2×4) or two-by-six (2×6) inch boards. In FIG. 1B, the deck 20 is constructed with plywood floorboards 22 which are considerably wider and thinner than standard two-by-six inch boards.

In either of the decks 20 shown in FIGS. 1A and 1B, the floorboards 22 are typically secured to lower support boards or joists 24 to form a floor 25 of the deck 20. The floor area 25 is typically constructed such that a spacing (S) is provided between adjacent floorboards 22, which accommodates, for example, contraction and expansion of the floorboards 22 and also allows for liquid drainage and air flow therebetween. Further, the deck 20 may include side railings 26 or other structures for enclosing the deck 20. Additionally, other add-ons may also be provided as part of the deck 20, for example, integrated seating areas or steps for accessing the deck 20.

The deck 20 is typically constructed using nails, particularly for securing the floorboards 22 to the lower support boards 24. Other suitable fastening methods may also be used, including, for example, screws and clips to secure the various parts of the deck 20.

Figure 2:
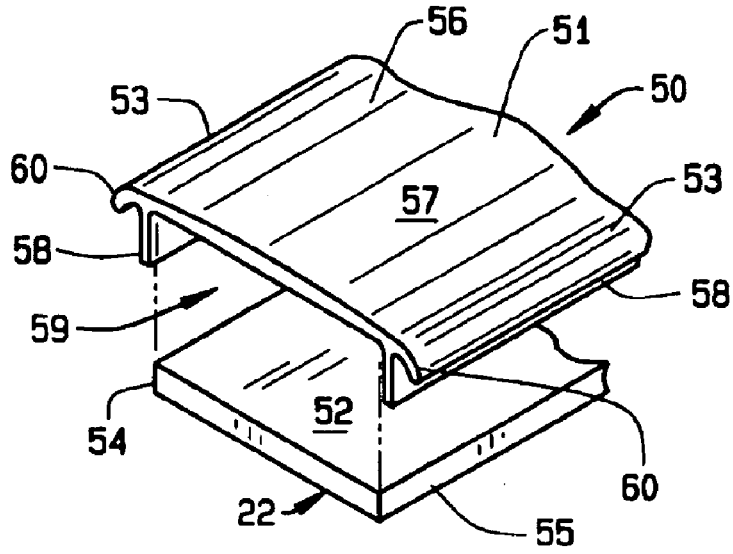
FIG. 2 is a top perspective view of a cover according to one embodiment of the present invention.

FIG. 2 illustrates a cover 50 according to one embodiment that is generally adapted to be received over a plywood board 22 to generally cover at least the top 52 and sides 54, 55 of the plywood board 22. It should be noted, however, that the cover 50 can also be adapted for fitting over and engaging a railing board, step, integrated seat, among other deck components. It should also be noted that the cover 50 as well as the other various embodiments of the invention can be used with different sizes and shapes of boards (e.g., 2×2, 2×4, 2×6 inch boards, plywood boards, etc.).

In the illustrated embodiment of FIG. 2, the cover 50 includes a top portion 56 and side portions 58 which form an interior 59. The interior 59 is sized to receive the plywood floorboard 22 therein, for example, to protect the floorboard 22 from external conditions (e.g., weather, wear and tear, etc.). The interior 59 has a cross-section that is generally an inverted U-shape or C-shape, the corners of which form substantially right angles. Other cross-sectional shapes are also possible for the interior 59 depending at least in part on the particular shape of board on which the cover 50 will be positioned.

As shown, the cover 50 further includes an overhang 60 at each side edge 53 of the top portion 56. Each overhang 60 extends outwardly beyond the corresponding side portion 58 of the cover 50. Each overhang 60 is also curved generally downwardly to form a drip edge to facilitate, for example, the flow of liquid (e.g., water from rain or from cleaning the deck 20, etc.) off the top portion 56. Alternatively, the overhangs may be generally straight and extend generally diagonally in a downwardly direction.

To further facilitate the flow of liquid off the top portion 56, the cover's top portion 56 may include a middle portion 51 that is slightly thicker than the side edges 53 of the top portion 56. The thickness of the top portion 56 can decrease from its middle portion 51 to its side edges 53. This taper is preferably up to about fifteen degrees, although other sizes can also be employed. The top portion 56 is thus provided with a upper surface 57 that slopes generally downwardly from its middle portion 51 towards its side edges 53. This, in turn, facilitates drainage off of the top portion 56 and thus the board 22 on which the cover 50 is positioned.

The cover 50 is adapted to be readily installed on the board 22. In one embodiment, the side portions 58 of the cover 50 are generally straight and angled at least slightly inward to frictionally receive and grip the board 22 between the side portions 58. The side portions 58 are resiliently biased inwardly toward the corresponding sides 54, 55 of the floorboard 22. The flexible tension grip of the side portions 58 onto the floorboard 22 prevents the cover 50 from lifting off the floorboards 22 during normal use of the deck. This feature also allows a user to readily install ("snap into place") a cover 50 on a floorboard 22 without requiring the use of fasteners. This feature also allows the cover 50 to be readily removed from the floorboard 22. For example, the cover 50 can be unsnapped off or unzipped from the floorboard 22 when the cover 50 is formed of sufficiently flexible material such as vinyl. Installing the cover 50 can onto a floorboard 22 without fasteners allows the cover 50 to accommodate (e.g., move or shift) at least some contraction and/or expansion of the board 22 within the cover 50.

Figure 3:
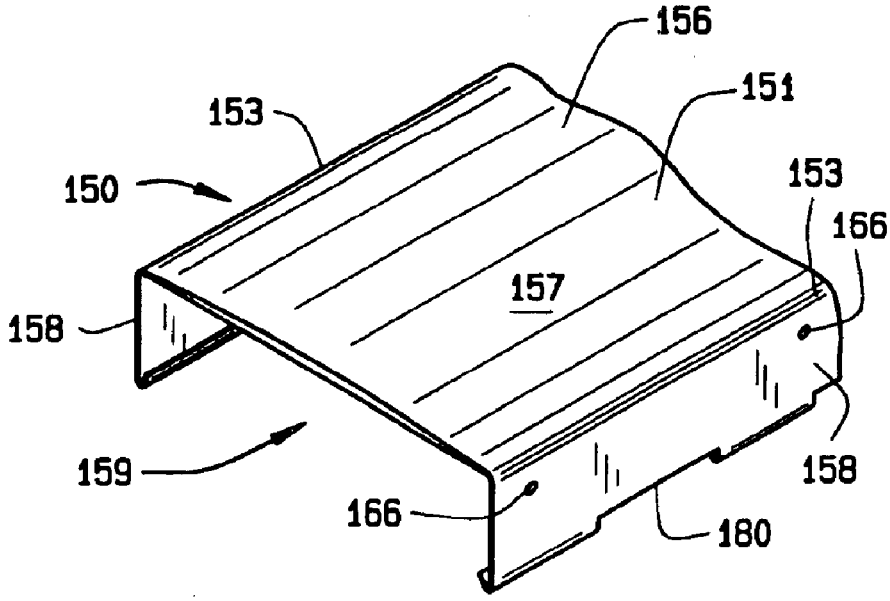
FIG. 3 is a top perspective view of another embodiment of a cover of the present invention.
Figure 4:
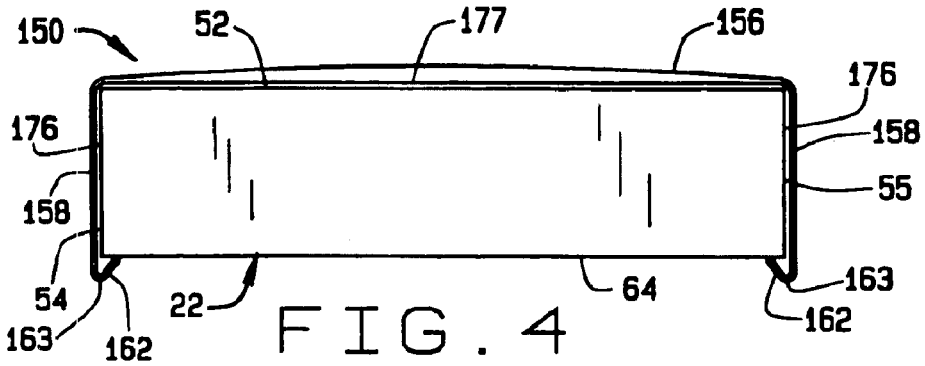
FIG. 4 is front elevation view of the cover shown in FIG. 3 positioned on a board.
Figure 5:
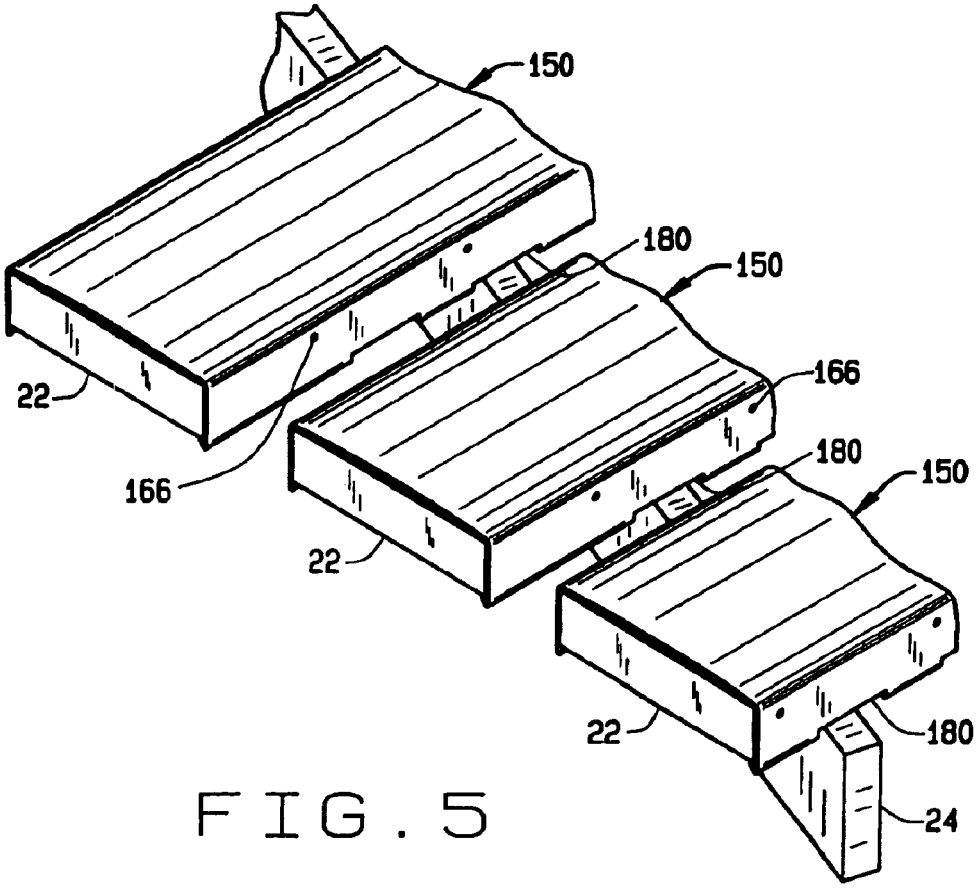
FIG. 5 is a top perspective view of three covers as shown in FIGS. 3 and 4 positioned on boards.

FIGS. 3 through 5 illustrate a cover 150 according to another embodiment of the invention. As shown, the cover 150 includes a top portion 156 and side portions 158 which form an interior 159 for protecting the floorboard 22, for example, from external conditions. The upper surface 157 of top portion 156 may slope generally downwardly from the middle portion 151 towards the side edges 153.

As shown in FIG. 5, the side portions 158 further include slots or notches 180 for accommodating another board, such as a lower support board or joist 24, positioned below the board 22. The slots 180 are adapted to extend around portions of the lower support board 24 when the cover 150 is positioned on the board 22.

In the exemplary embodiment, each slot 180 has a cross-section that is generally an inverted U-shape or C-shape, the corners of which form substantially right angles. Other cross-sectional shapes can also be employed for the slots depending at least in part on the shape of the board or other deck component to be accommodated by the slots.

The slots 180 can be sized to accommodate a wide range of joist configurations, joist sizes and joist positioning conditions and angles relative to the floorboards. In at least one embodiment, each slot 180 is sized to accommodate joists positioned relative to the floorboards at various angles between about forty-five (45°) degrees and about ninety (90°) degrees.

Figure 6:
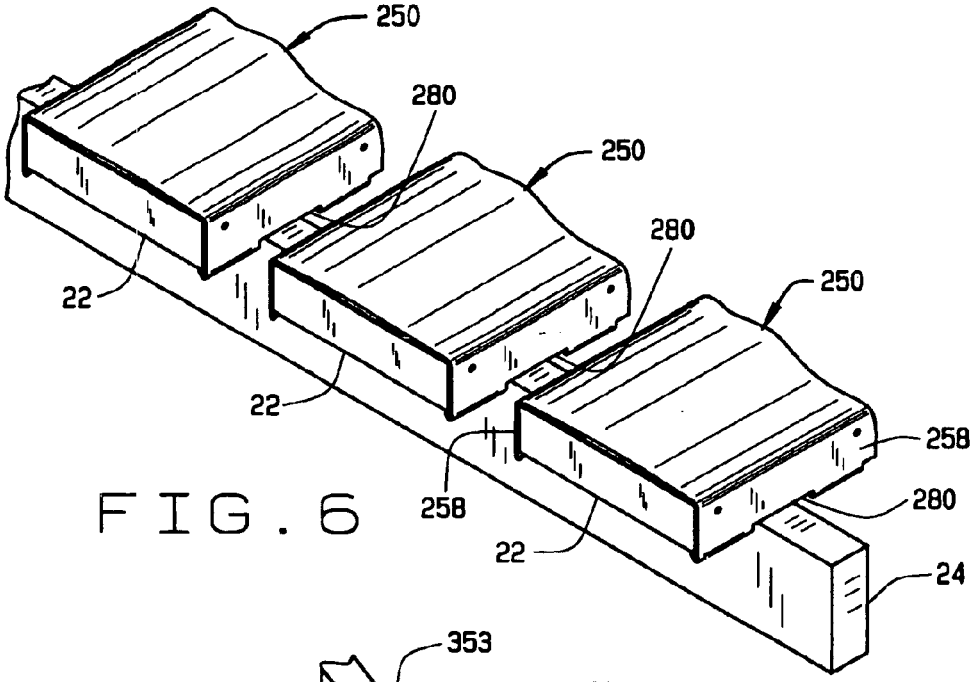
FIG. 6 is a top perspective view of another embodiment of a cover illustrating three of such covers positioned on boards.

The slots 180 can be positioned to accommodate for different joist positioning conditions and angles relative to the floorboards. For example, the slots 180 can be staggered to accommodate a joist 24 forming an oblique angle (e.g., a forty-five degree (45°) angle, etc.) with the floorboards 22, as shown in FIG. 5. Or for example, the slots 280 on one side portion 258 can be aligned with the slots 280 on the other side portion 258 to accommodate a joist 24 that is generally perpendicular to the floorboards 22, as shown for the cover 250 in FIG. 6.

It should be noted that the dimensions and locations of the slots may vary depending on the requirements of the particular application in which the covers will be used. Preferably, the slots are adapted to accommodate for all reasonably expected joist spacing and joist positioning conditions in a deck.

With further reference to FIG. 4, the side portions 158 include engagement portions 162 for engaging the bottom 64 of the board 22. To provide an even more secure engagement with the board 22, each side portion 158 may be resiliently biased inwardly toward the corresponding side 54, 55 of the floorboard 22. The flexible tension grip of the side portions 158 onto the floorboard 22 prevents the cover 50 from lifting off the floorboards 22 during normal use of the deck. A user can readily install ("snap into place") a cover 150 on a floorboard 22 without requiring the use of fasteners, which allows the cover 150 to be readily removed from the floorboard 22 and to accommodate (e.g., move or shift) at least some contraction and/or expansion of the board 22 within the cover 150. For example, the cover 150 can be unsnapped off or unzipped from the floorboard 22 when the cover 150 is formed of sufficiently flexible material such as vinyl.

In the illustrated embodiment, the side portions 158 each include inwardly bent portions 162 which have a cross-section that is generally U-shaped. Other cross-sectional shapes (e.g., L-shaped, etc.) are also possible depending on the particular application in which the cover 150 will be used. For example, in alternate embodiments, the cover's side portions may be generally straight without engagement portions, as shown in FIG. 2.

To allow liquid to drain out of the engagement portions 162, any suitable number of (i.e., one or more) holes or openings 163 are preferably provided in the bottommost surface of the u-shape.

In at least some embodiments, the cover 150 is sized at least slightly larger (dimensionally) than the board 22 on which the cover 150 will be positioned. For example, the cover 150 can be constructed slightly larger than the board 22 such that a gap 176 (e.g., one-sixteenth inch gap, etc.) is respectively defined between the cover's side portions 158 and the corresponding sides 54, 55 of the board 22. A gap 177 can also be defined between the cover's top portion 156 and the top 52 of the board 22. The gaps 176 and 177 allow at least some contraction and/or expansion of the board 22 within the cover 150.

As shown in FIGS. 3 and 5, the side portions 158 include openings 166 for venting vapor, liquid evaporating from under the deck, and/or moisture rising from the ground. The holes 166 allow the venting or escape of this moisture that may otherwise become trapped within the interior 159 of the cover 150 and cause damage to the floorboard 22 or other deck components.

Figure 7:
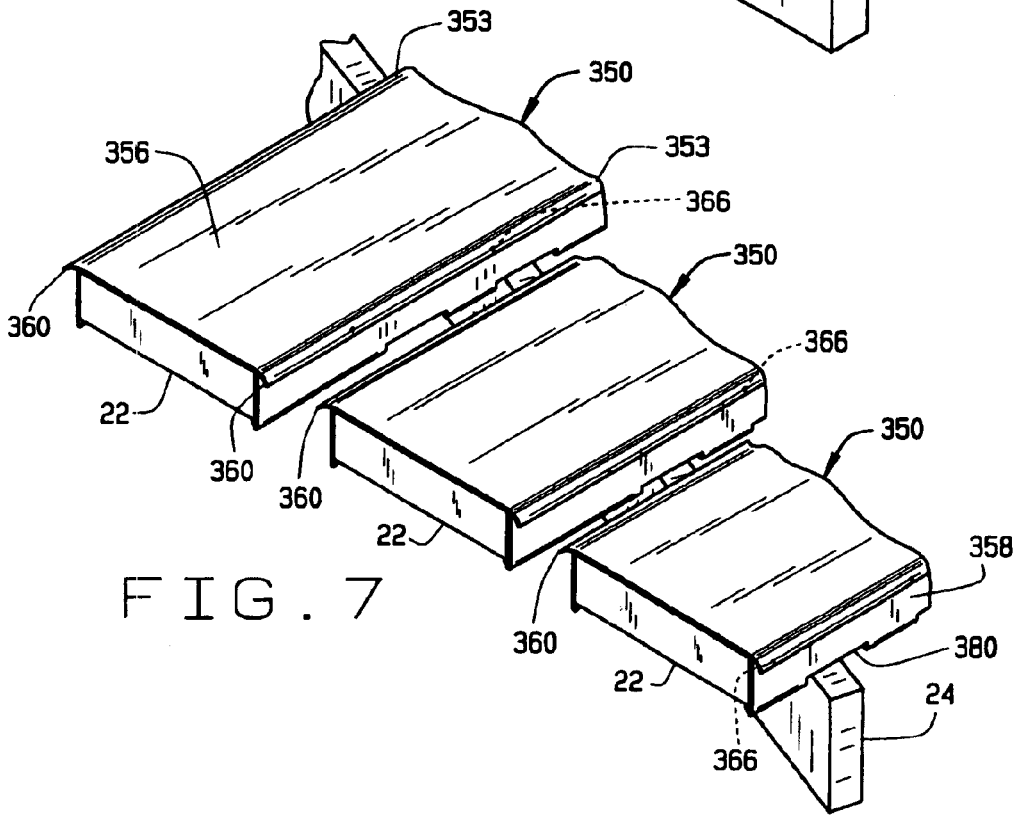
FIG. 7 is a top perspective view of another embodiment of a cover illustrating three of such covers positioned on boards.

FIG. 7 illustrates another embodiment of a cover 350 which is adapted to accommodate the lower support board 24. As shown, the cover side portions 358 have slots or notches 380 therein for accommodating the lower support board 24. The side portions 358 also include openings 366 which allow the venting or escape of moisture trapped within the interior of the cover 350.

Overhangs 360 are provided at each side edge 353 of the top portion 356. Each overhang 360 is curved generally downwardly to form a drip edge to facilitate the flow of liquid off the top portion 356. Alternatively, the overhangs may be generally straight and extend generally diagonally in a downwardly direction.

In the illustrated embodiment, the overhangs 360 and the holes 366 are adapted such that the overhangs 360 project downwardly at least to the location of the holes 366. This allows the overhangs 360 to cover the holes 366, for example, to prevent moisture (e.g., water from rain or from cleaning the deck) from entering the holes 366.

Figure 9:
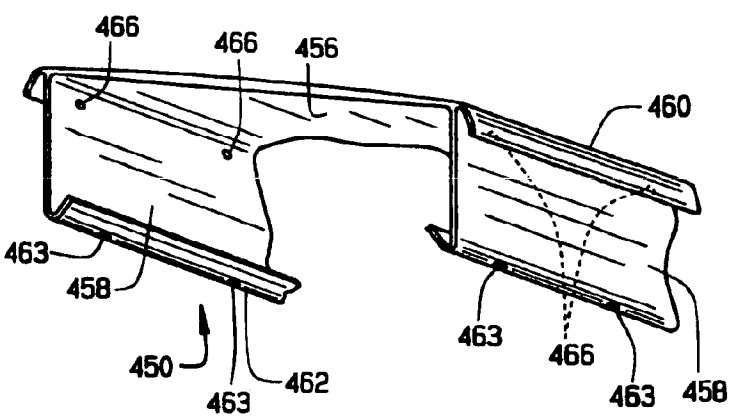
FIG. 9 is a bottom perspective view of the cover shown in FIG. 8.
Figure 8:
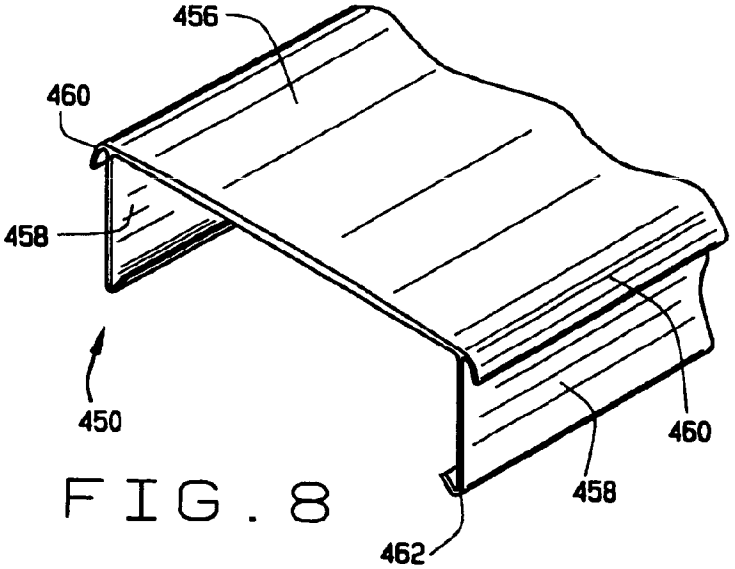
FIG. 8 is a top perspective view of a cover according to another embodiment of the present invention.
Figure 10:
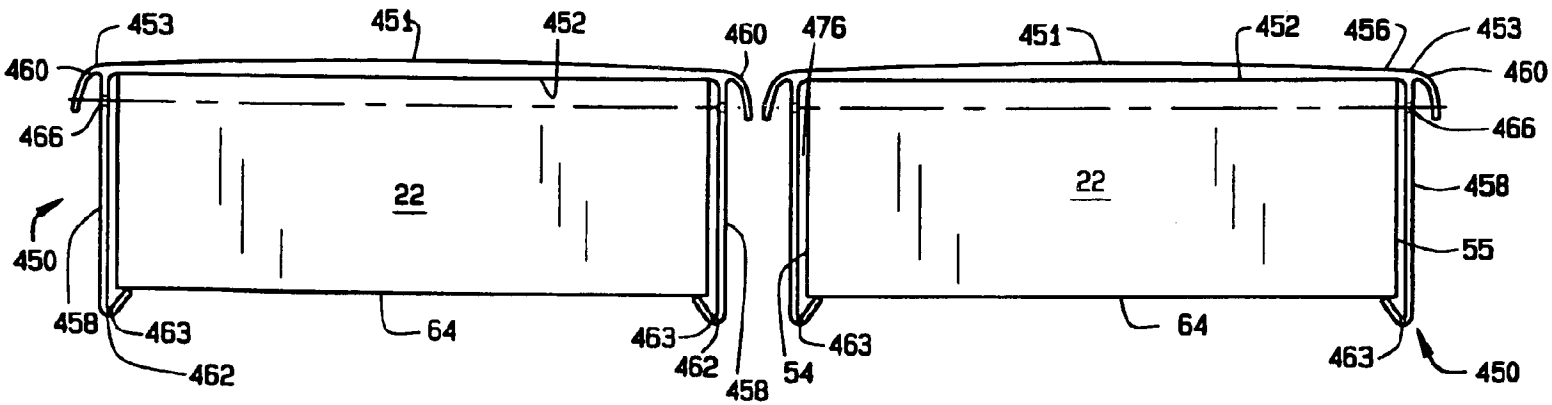
FIG. 10 is a front elevation view of two covers as shown in FIGS. 8 and 9 positioned on boards.

FIGS. 8 through 10 illustrate another embodiment of a cover 450 that includes a top portion 456 and side portions 458. As shown, the side portions 458 includes inwardly bent portions 462 having cross-sections that are generally U-shaped for engaging the board 22. Other cross-sectional shapes (e.g., L-shaped, etc.) are also possible depending on the particular application in which the cover 150 will be used. For example, in alternate embodiments, the cover's side portions may be generally straight without the inwardly bent portions 462, as shown in FIG. 2.

To allow liquid to drain out of the engagement portions 462, any suitable number of (i.e., one or more) holes or openings 463 are preferably provided in the bottommost surface of the u-shape.

The cover 450 also includes a plurality of openings 466 provided in the side portions 458 for venting of vapor or moisture from the cover 450. The cover 450 also includes overhangs 460 curving generally downwardly from each side edge 453 of the top portion 456. The overhangs 460 form a drip edge to facilitate the flow of liquid off the top portion 456. Preferably, the overhangs 360 project downwardly at least to the location of the holes 366 to prevent moisture (e.g., water from rain or from cleaning the deck) from entering the holes 366.

To further facilitate the flow of liquid off the top portion 456, the thickness of the top portion 456 decreases from its middle portion 451 to its side edges 453. The upper surface of the top portion 456 thus slopes generally downwardly from its middle portion 451 towards its side edges 453.

Figure 11:
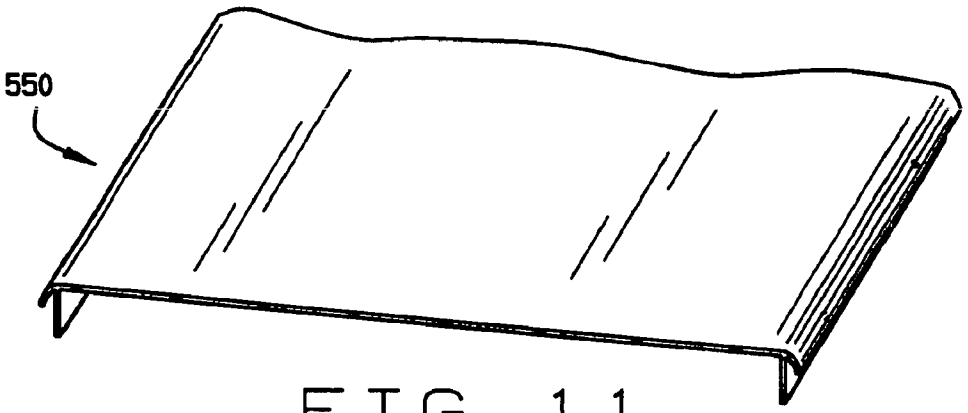
FIG. 11 is a top perspective view of another embodiment of a cover of the present invention.
Figure 12:
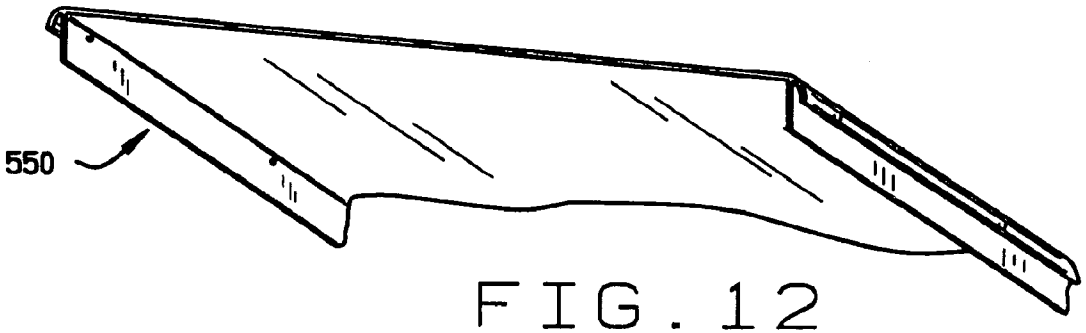
FIG. 12 is a bottom perspective view of the cover shown in FIG. 11.
Figure 13:
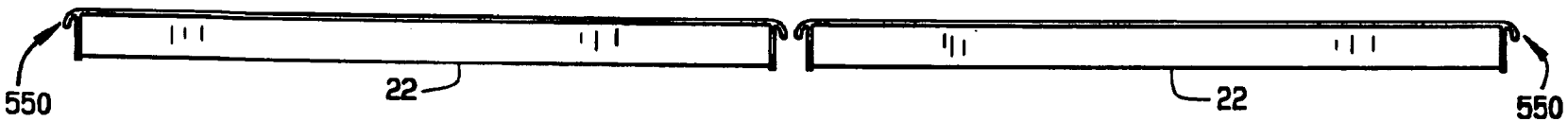
FIG. 13 is a front elevation view of two covers as shown in FIGS. 11 and 12 positioned on plywood boards.

FIGS. 11 through 13 illustrate another embodiment of a cover 550 that includes overhangs and moisture venting holes. The cover 550 is adapted for connection to plywood floorboards 22, which are considerably wider and thinner than standard two-by-six inch boards.

Figure 14:
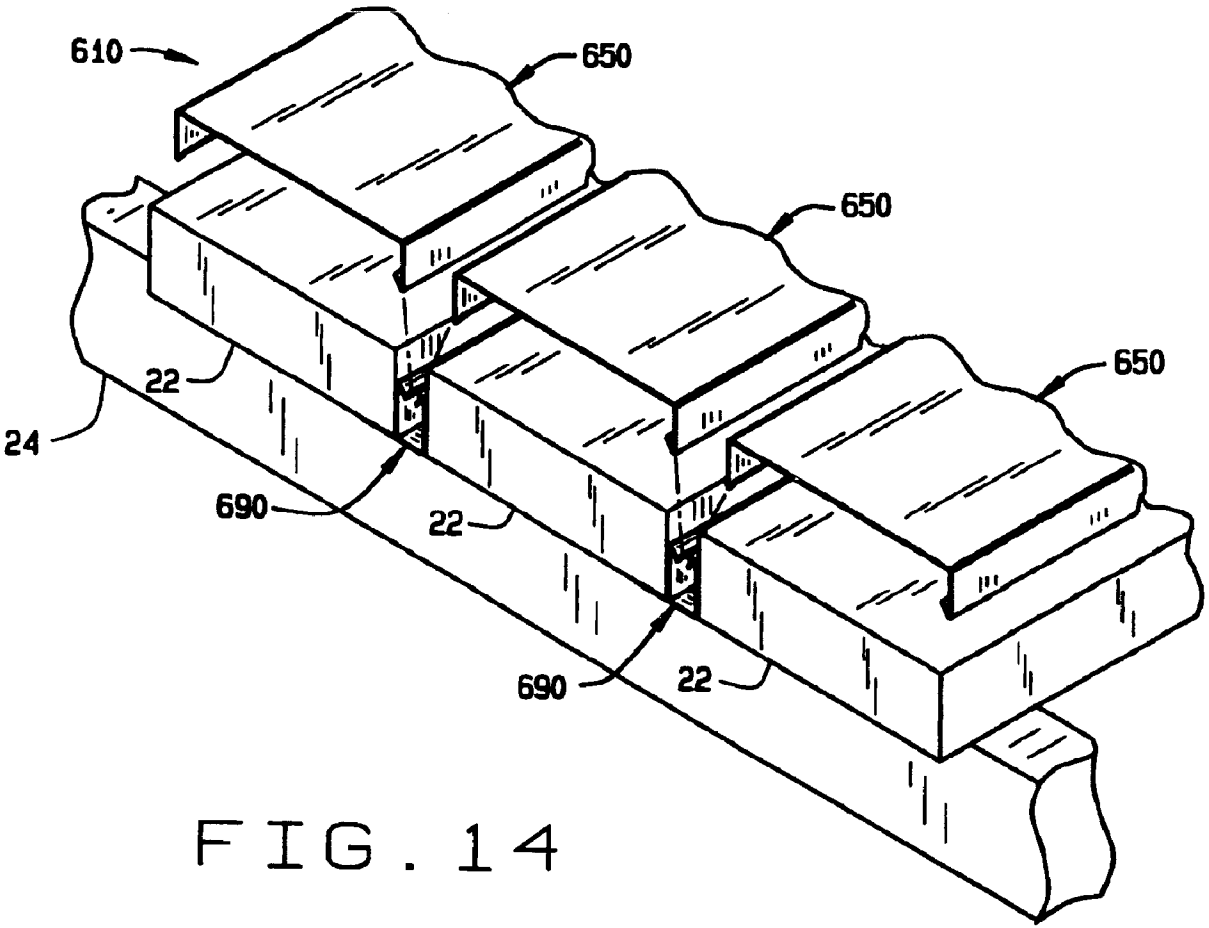
FIG. 14 is an exploded perspective view of a system for covering boards in a deck according to another embodiment of the invention.
Figure 15:
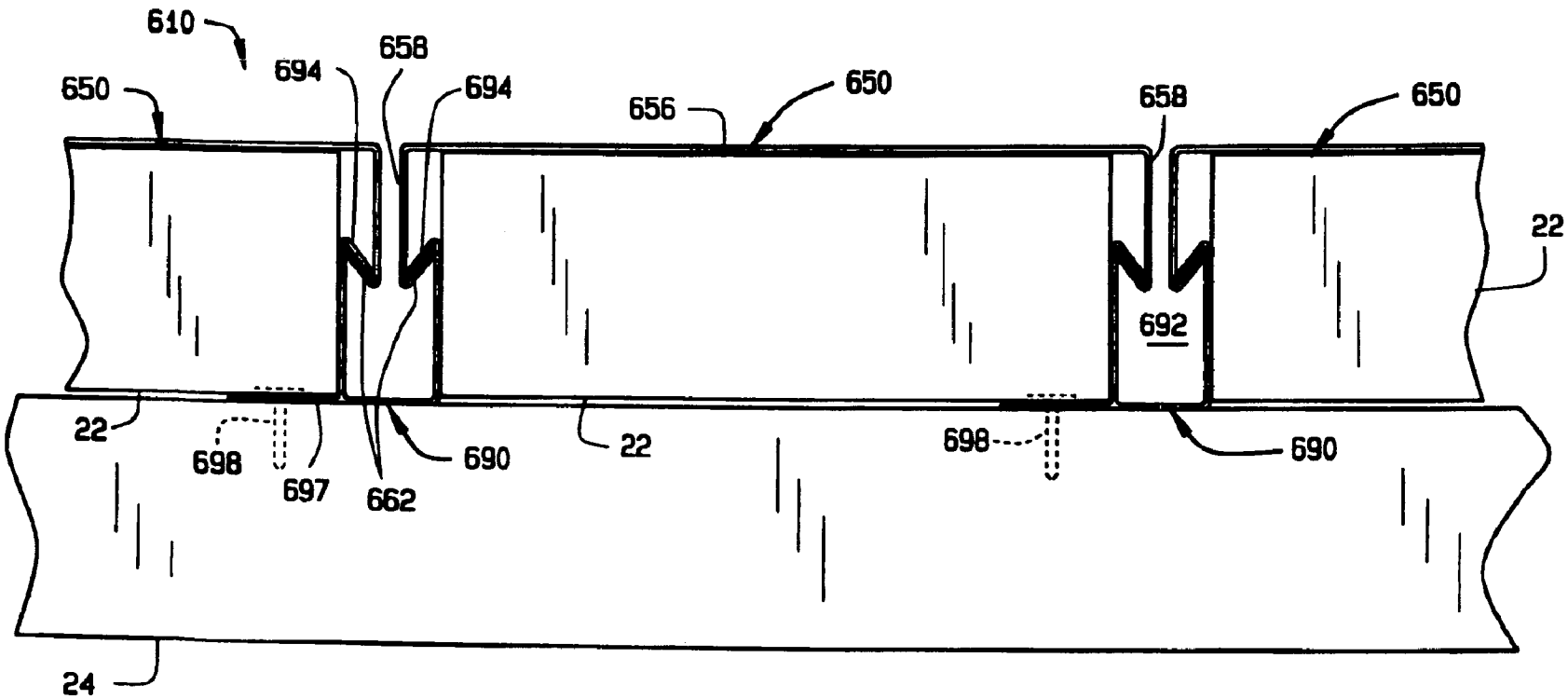
FIG. 15 is a front elevation view of the system shown in FIG. 14.

FIGS. 14 through 15 illustrate a system 610 for covering boards (e.g., floorboards 22, etc.) in a deck. As shown, the system includes covers 650 each of which includes a top portion 656 and side portions 658. The cover's top portion 656 may include an upper surface that slopes generally downwardly from its middle portion towards the side edges.

The system further includes couplings 690 (FIGS. 16A and 16B) each of which is adapted to be coupled to at least one joist 24. Each coupling 690 is sized to be positioned between at least two adjacent floorboards 22. As shown in FIG. 15, each coupling 690 is preferably positioned in contact with and abutting the sides of the corresponding pair of floorboards 22 between which the coupling 690 is positioned. Accordingly, the couplings 690 provide generally uniform and consistent spacing between the floorboards 22.

Figure 16A:
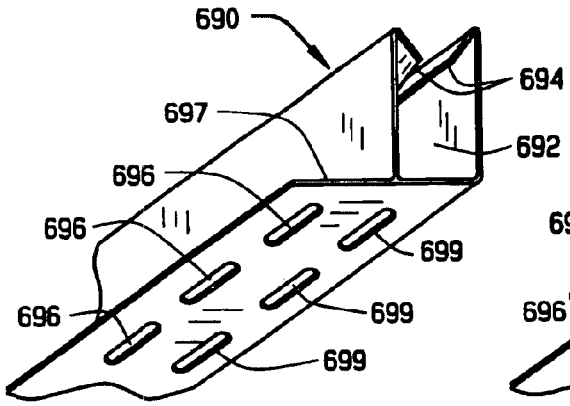
FIG. 16A is a top perspective view of a coupling according to one embodiment of the invention.
Figure 16B:
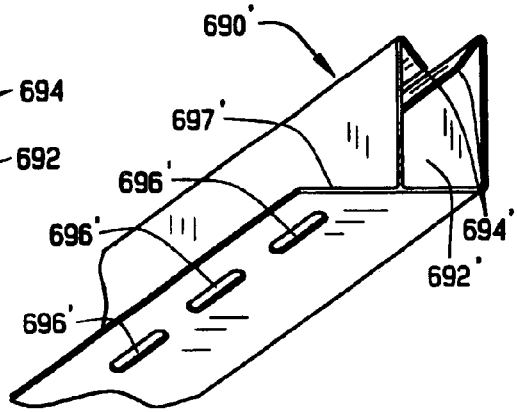
FIG. 16B is a top perspective view of a coupling according to another embodiment of the invention.

As shown in FIGS. 16A and 16B, each coupling 690 defines a channel 692 adapted to receive and retain therein inwardly bent portions 662 of the corresponding side portions 658. The side portions 658 and couplings 690 include interlocking or interengageable portions 662 and 694, respectively, that when engaged provide a relatively secure interlocking engagement between the covers 650 and the couplings 690.

In the illustrated embodiment, each channel 692 includes inwardly bent portions 694 for engaging the inwardly bent portions 662 of the side portions 658. The inwardly bent portions 662 have a cross-section that is a generally U-shape, whereas the inwardly bent portions 694 of the channels 692 have a cross-section that is a generally inverted U-shape. Other cross-sectional shapes (e.g., L-shaped, etc.) are also possible depending on the particular application in which the system 610 will be used. Further, other suitable methods of engaging and/or interlocking the covers 650 to the couplings 690 can also be employed.

To accommodate for contraction and/or expansion of the couplings 690, each coupling 690 includes fastener slots or oblong holes 696. The fastener slots 696 are spaced apart along a length of a flange 697 of the coupling 690. The fastener slots 697 allow a wide range of suitable fasteners 698 (e.g., nails, screws, etc.) to be inserted through the slots 696 and then fastened to the joist 24, thus attaching the coupling 690 to the joist 24.

As shown in FIG. 16A, the couplings 690 may also include one or more outlets or openings 699 in a lower surface of the channel 692. The openings 699 allow liquid (e.g., rainwater flowing into the channels 692 from off the cover top portions 656, spilled beverages, etc.) to drain out of the couplings 692 to an area under the deck.

Additionally, or alternatively, the deck on which the system 610 is installed can be provided with a gradient such that the deck slopes generally downwardly towards an outer side of the deck. For example, the couplings 690' shown in FIG. 16B do not include opening 699 in the lower channel surface but instead are arranged such that their channels 692' slope generally downwardly along with the deck. This, in turn, facilitates flow of liquid (e.g., a spilled beverage, rainwater, water from other sources, etc.) through the channels 692' and ultimately out of the couplings 690'. In this manner, the channels 692' function as gutters or troughs which direct the liquid away from the area under the deck.

The system 610 can be employed in the following exemplary manner. A first coupling 690 is attached to one or more joists 24 using the fastener slots 696 and fasteners 698. A floorboard 22 is positioned adjacent, preferably in contact with and abutting, the first coupling 690 and then attached to one or more joists 24. A second coupling 690 is positioned adjacent, preferably in contact with and abutting, the floorboard 22 and then attached to one or more joists 24 using fasteners 698 and slots 696. By positioning the floorboards 22 and couplings 690 in contact with one another during installation of the deck, generally uniform and consistent spacing between the floorboards 22 is maintained.

cover 650 can then be positioned on the floorboard 22. The cover's inwardly bent portions 662 engaged with the inwardly bent portions 694 of the channels 692 of the first and second couplings 690, which are positioned on opposite sides of the floorboard 22.

Figure 17:
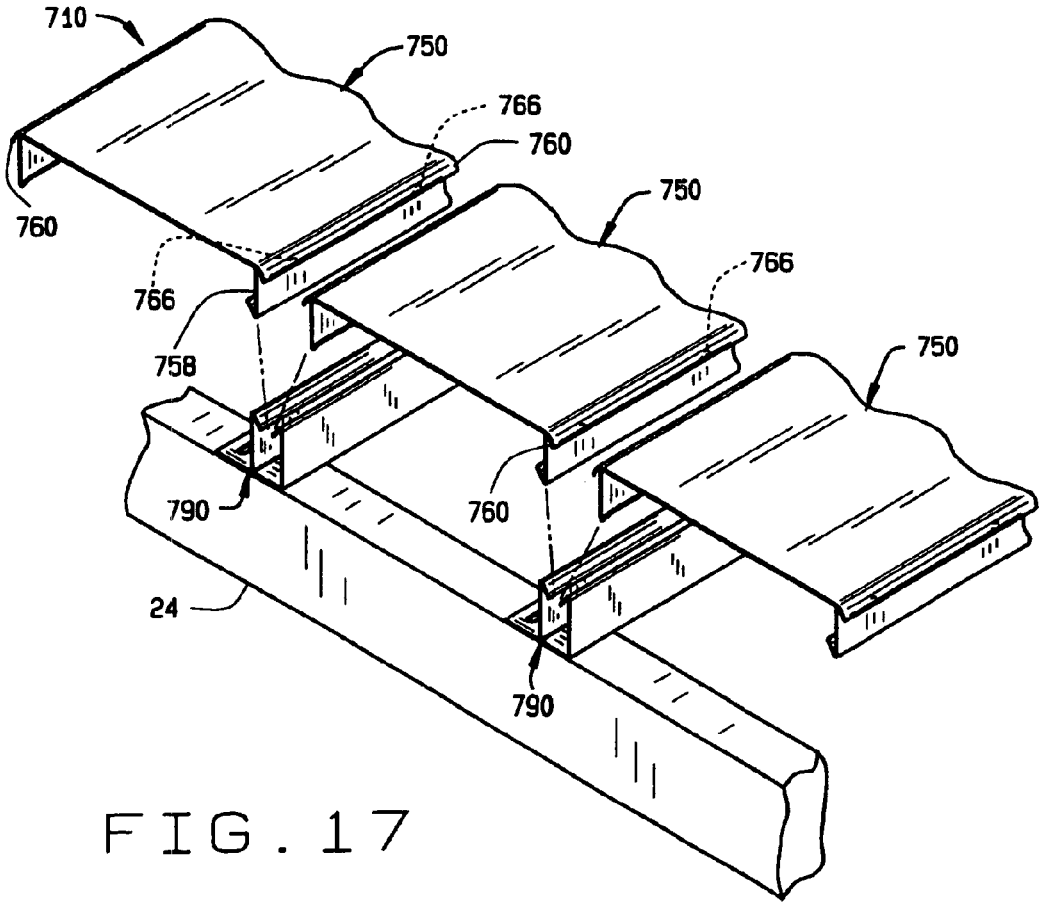
FIG. 17 is an exploded perspective view of a system for covering boards in a deck according to another embodiment of the invention.

FIG. 17 illustrates another embodiment of a system 710 for covering boards (e.g., floorboards 22, etc.) in a deck. As shown, the system includes covers 750 and couplings 790. The couplings 790 are each adapted to be coupled to at least one joist 24 and sized to be positioned between at least two adjacent floorboards 22.

Each cover 750 includes overhangs 760 curving generally downwardly from each side edge of the cover's top portion. Alternatively, the overhangs may extend generally downwardly and diagonally relative to the cover's top portion.

In addition, each cover 750 also includes holes 766 in its side portions 758 for venting moisture from an area between the cover 750 and the board 22 when the cover 750 is positioned on the board 22. In the illustrated embodiment, the overhangs 760 project downwardly to at least the location of the holes 766 to prevent moisture (e.g., rainwater) from entering the holes 766.

In another exemplary form, the present invention provides methods for covering a deck. In one embodiment, the method generally comprises: positioning one or more plywood boards on the floorboards of a deck; and positioning a cover 50, 150, 250, 350, 550, 650, 750 on the plywood boards.

It should be noted that the various embodiments of the cover are not limited to use with wood boards or structural members of a particular type, size, and shape. Embodiments of the invention can be used with, for example, solid wood boards, composite wood boards, metal boards or beams, corrugated steel floor members, and floor members constructed of other types of composite materials. In certain embodiments, the underlying structural member on which a cover is positioned is formed of corrugated steel.

In addition, any of the various covers of the invention can be constructed of a particular size corresponding to the length and width of the board on which the cover will be installed. Alternately, the cover, after it is constructed, may be cut to the length of the board on which it will be installed.

A wide range of materials can be used for the embodiments of the invention, such as vinyl materials, nylons, plastics (e.g., polyvinyl chloride, etc.), extrudable materials, weather durable materials, etc. By way of example only, a flexible vinyl material is used for at least one of the covers shown, which allows the cover to expand and contract in response to changing weather conditions. A wide range of colors can also be used for the various components comprising one of the covers of the invention.

In at least some embodiments, the cover can have a monolithic construction in which the cover's top and side portions are integrally formed as a single component (e.g., as a single extruded plastic piece, etc.). Alternatively, different or additional component parts constructed of different materials can be used for a cover of the present invention. For example, the cover's top and side portions may comprise separate components that are secured to one another, for example, by welding and/or other suitable fastening methods.

Any of the covers of the present invention can also include different textured top portions or treads, for example, to at least reduce the likelihood of a user slipping when walking on the top portion.

Accordingly, embodiments of the present invention provide covers that can be readily and securely installed on the boards of a deck without the need for glue or other adhesive type material. This, in turn, allows the board to expand and/or contract within the interior of the cover without affecting the cover itself (e.g., cracking the cover when the board expands, etc.). Further, the cover can be constructed slightly larger than the board to provide a gap between the cover and the board to accommodate at least some expansion and/or contraction of the board within the cover.

Any of the various covers can be readily installed with relative ease. The covers can also be readily removed and replaced, for example, for repair and/or for aesthetic considerations. A user can install or replace covers to change the appearance of a deck, for example, to make the deck's appearance more consistent with surrounding features, such as the siding on a house.

Embodiments of the invention can protect boards of a deck from external conditions (e.g., weather, scuffing and other wear and tear through use of the deck, etc.). Indeed, deck provided with covers in accordance with the present invention requires less on-going maintenance.

By protecting a deck from external conditions, embodiments of the present invention eliminate, or at least reduce, the need for use of treated wood which is often impregnated with toxic chemicals (e.g., arsenic), thus making decks safer to use. Embodiments also make decks safer by protecting bare foot users from wood splinters and protruding fasteners, such as raised nails.

Embodiments also allow boards and components made from a wide range of materials to be used for a deck, including construction grade plywood flooring, wood composite boards, metal components, and untreated wood pine board. Indeed, embodiments of the present invention allow the costs associated with building decks to be reduced because relatively inexpensive materials or substrates can be used for the underlying structural members, which are then provided with and protected by covers of the present invention.

In view of the foregoing, it should be understood that the present invention relates to and includes deck covers having one or more of the following: overhangs; notches or slots for accommodating another board beneath the board on which the cover will be positioned; a top portion having an upper surface sloping generally downwardly from a middle portion towards its side edges; holes for venting moisture from an area between the cover and the board when the cover is positioned on the board; and/or covers adapted for use with couplings as described above. It should be further understood that the present invention further includes boards provided with at least one of such covers, deck-like structures provided with at least one of such covers, and methods of applying at least one of such covers to a board, a flooring component (internal or external) decks, docks, wharfs, floors (both internal and external), and the like.

It is anticipated that embodiments of the present invention will be used in a wide range of decks, docks, wharfs, internal and/or external floors, and the like. Accordingly, the specific references to deck herein should not be construed as limiting the scope of the present invention.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cover for a board having a top, a bottom and a pair of opposed sides, the cover comprising a top portion, and a pair of opposed side portions downwardly depending from the top portion to frictionally receive and grip the board between the side portions when the cover is positioned on the board, each of the cover's side portions defining at least one slot adapted to extend around portions of another board positioned below the board when the cover is positioned on the board, the cover's top portion including a pair of opposed side edges and an overhang extending generally outwardly and downwardly from each said side edge of the top portion.

2. The cover of claim 1 wherein each of the slots is sized to accommodate the another board when the another board is positioned relative to the board at an angle between about forty-five degrees and about ninety degrees.

3. The cover of claim 1 wherein each of the cover's side portions includes at least one opening therein for venting an area between the board and the cover when the cover is positioned on the board.

4. The cover of claim 3 wherein the openings in the cover's side portions are at least partially covered by the overhangs.

5. The cover of claim 1 wherein the cover's top portion includes a pair of opposed side edges, a middle portion, and an upper surface sloping generally downwardly from the middle portion towards the side edges.

6. The cover of claim 1 wherein the cover's side portions are inwardly angled to frictionally receive and grip the board between the side portions when the cover is positioned on the board.

7. The cover of claim 1 wherein the side portions include inwardly bent portions for engaging the bottom of the board.

8. A deck comprising at least one floorboard having a top, a bottom, and a pair of opposed sides, at least one joist below the floorboard, and at least one cover having a top portion and a pair of opposed side portions downwardly depending from the top portion, the cover's top portion and side portions being adapted to generally cover at least the top and sides of the floorboard, each of the cover's side portions including at least one slot adapted to extend around portions of the joist when the cover is positioned on the floorboard, the cover's too portion including a pair of opposed side edges and an overhang extending generally outwardly and downwardly from each said side edge of the top portion, the cover's side portions having openings therein for venting a area between the floorboard and the cover when the cover is positioned on the floorboard, the openings in the cover's side portions being at least partially covered by the overhangs.

9. The deck of claim 8 wherein the cover's side portions are adapted to frictionally receive and grip the floorboard between the side portions when the cover is positioned on the floorboard.

10. The deck of claim 8 wherein each of the slots is sized to accommodate the joist when the joist is positioned relative to the floorboard at an angle between about forty-five degrees and about ninety degrees.

11. The deck of claim 8 wherein the joist is positioned generally perpendicular to the floorboard.

12. The deck of claim 8 wherein the joist is positioned at an oblique angle relative to the floorboard.

13. The deck of claim 8 wherein the cover's top portion includes a pair of opposed side edges, a middle portion, and an upper surface sloping generally downwardly from the middle portion towards the side edges.

14. The deck of claim 8 wherein the cover's side portions include inwardly bent portions for engaging the bottom of the floorboard.

15. A cover for an elongate deck component having a top, a bottom, and a pair of opposed sides, the cover comprising a top portion, and a pair of opposed side portions downwardly depending from the top portion, the cover's top portion and side portions being adapted to generally cover at least the top and sides of the deck component, each of the cover's side portions including at least one opening therein for venting an area between the cover and the deck component when the cover is positioned on the deck component, the cover's top portion including a pair of opposed side edges and an overhang extending generally outwardly and downwardly from each said side edge of the too portion, the openings in the cover's side portions being at least partially covered by the overhangs.

16. The cover of claim 15 wherein the deck component comprises a floorboard of a deck.

17. The cover of claim 16 wherein each of the cover's side portions define at least one slot adapted to extend around portions of a joist positioned below the floorboard when the cover is positioned on the floorboard.

18. The cover of claim 15 wherein the top portion includes a pair of opposed side edges, a middle portion, and an upper surface sloping generally downwardly from the middle portion towards the side edges.

19. The cover of claim 15 wherein the side portions are adapted to frictionally receive and grip the deck component between the side portions when the cover is positioned on the deck component.

20. The cover of claim 19 wherein the side portions include engagement portions for engaging the bottom of the deck component.

21. The cover of claim 1, wherein each said overhang is curved generally downwardly relative to the cover's top portion for farming a drip edge to facilitate the flow of liquid off the cover's top portion.

22. The deck of claim 8, wherein each said overhang is curved generally downwardly relative to the cover's top portion for forming a drip edge to facilitate the flow of liquid off the cover's top portion.

23. The cover of claim 15, wherein each said overhang is curved generally downwardly relative to the cover's top portion for forming a drip edge to facilitate the flow of liquid off the cover's top portion.

* * * * *

UNITED STATES PATENT AND TRADEMARK OFFICE

CERTIFICATE OF CORRECTION

PATENT NO. : 6,955,021 B2
DATED : October 18, 2005
INVENTOR(S) : Rodney H. Thomas It is certified that error appears in the above-identified patent and that said Letters Patent is hereby corrected as shown below:

Column 3,
Lines 15 and 17, delete “top” before “perspective view”.

Column 4,
Line 44, delete “can” after “cover 50”.

Column 6,
Line 45, replace “360” with -- 460 --.
Lines 46 and 48, replace “366” with -- 466 --.

Column 7,
Line 66, insert -- A -- before “cover 650”.
Line 67, replace “engaged” with -- engage -- after “portions 662”.

Column 10,
Line 47, replace “too portion” with -- top portion --.

Column 11,
Line 17, replace “too portion” with -- top portion --.

Column 12,
Line 14, replace “farming” with -- forming --.

Signed and Sealed this

Twenty-first Day of February, 2006

JON W. DUDAS
*Director of the United States Patent and Trademark Office*